US006613110B2

(12) United States Patent
Sanyal

(10) Patent No.: US 6,613,110 B2
(45) Date of Patent: Sep. 2, 2003

(54) INHIBITION OF REFLECTIVE ASH BUILD-UP IN COAL-FIRED FURNACES

(75) Inventor: Anupam Sanyal, Naperville, IL (US)

(73) Assignee: Benetech, Inc., Montgomery, IL (US)

( * ) Notice: Subject to any disclaimer, the term of this patent is extended or adjusted under 35 U.S.C. 154(b) by 44 days.

(21) Appl. No.: 09/758,666

(22) Filed: Jan. 11, 2001

(65) Prior Publication Data

US 2002/0088170 A1 Jul. 11, 2002

(51) Int. Cl.[7] ..... C10L 9/10
(52) U.S. Cl. ..... 44/627
(58) Field of Search ..... 44/627, 621

(56) References Cited

U.S. PATENT DOCUMENTS 4,173,454 A * 11/1979 Heins ..... 110/342

5,819,672 A * 10/1998 Radway et al. ..... 110/341

OTHER PUBLICATIONS

Buecker et al., Power Engineering, Fuel Switching, *PRB Coal Switch Not A Complete Panacae*, pp. 76, 78 and unnumbered page, Nov. 2000.

Hottell et al., *Radiant–Heat Transfer*, Section 4.3, pp. 66–67, publication unknown, date unknown.

* cited by examiner

*Primary Examiner*—Cephia D. Toomer
(74) *Attorney, Agent, or Firm*—Thompson Coburn, LLP

(57) ABSTRACT

A method, for inhibiting accumulation of light-colored ash on the walls of a furnace in which coal containing high levels of (coal-bound) calcium is burned, comprises adding an iron compound to the coal prior to burning the coal, burning the coal, and producing calcium ferrite, thereby improving heat transfer in furnaces and resultant plant efficiency without adverse environmental consequences.

13 Claims, No Drawings

INHIBITION OF REFLECTIVE ASH BUILD-UP IN COAL-FIRED FURNACES

BACKGROUND OF THE INVENTION (1) Field of the Invention

The present invention relates to ash formation during the burning of coal and more particularly to methods and compositions for treatment of coal to reduce the amount of ash deposition onto surfaces during the burning of coal.

(2) Description of the Related Art

Sub-bituminous coal of the Powder River Basin of the United States typically includes a significant amount of calcium bound within the coal structure. In fact, the typical calcium level of this type of coal burned in industrial boilers in the United States today is substantially higher than it had been in the past and that level is expected to increase in the future as industries continue to turn to lower sulfur level coal.

When the coal is burned, the calcium in the coal is converted to calcium oxide. The formation of calcium oxide results in an ash that is reflective and whiter than the fly ash produced upon combustion of bituminous coal. This reflective ash accumulates on surfaces situated in the structure in which the burning takes place. Such structures will be referred to herein as "furnaces," as such term is considered in its broad sense to refer to any enclosed structure in which heat is produced. A particular situation in which such ash formation is encountered is in furnaces employed in boiler systems, but the furnaces contemplated herein are not limited to such systems and may be incorporated into any number of uses.

Prominent among the surfaces on which reflective ash tends to accumulate are the furnace tube walls through which heat is to be transferred from the combustion taking place in the furnace. Such ash accumulation is undesirable because the layer it forms over the surfaces is an insulative barrier that reduces the heat transfer through the surfaces, thereby reducing the efficiency of heat transfer from the furnace. Such ash accumulation is also undesirable because the reflective ash layer reflects the heat back into the burner area, increasing the gas and flame temperatures beyond that for which the furnace was designed, which in turn causes the increased heat to radiate back to the fly ash, eventually creating a slagging environment. Moreover, because of the inadequate heat transfer to the water flowing through the furnace wall tubes, the furnace exit gas temperature (FEGT) rises above the design level, increasing the fouling propensity in the convective zone and, in the case of the boiler, finally increasing the boiler exit gas temperature. The increased FEGT also raises the temperature of steam in downstream heat absorption sections above design conditions, requiring use of cooling spray water to reduce the steam temperature.

The formation of this type of ash has become more pronounced in recent years. Many boiler furnaces were designed for burning high sulfur bituminous coal. However, as alluded to above, beginning in the late 1970's and early 1980's, environmental concerns led to conversion from burning high sulfur bituminous coal to burning low sulfur coals, such as that from the Powder River Basin in Wyoming (PRB coal), began. Even though the ash content of PRB coals is lower than that of the high sulfur coals they replace, PRB coals tend to be high in calcium. Thus, burning the lower sulfur coals in the furnaces designed for relatively high sulfur coal has resulted in increased slagging, and particularly increased white ash formation. See, for example, "PRB Coal Switch Not a Complete Panacea," by Buecker, B. and Meinders, J., *Power Engineering,* November 2000, pp. 76–80.

Conventionally, equipment such as soot blowers and water lances have been employed to reduce slagging and lower the FEGT, but with limited success and the additional costs, efforts and interference associated with such equipment. Moreover, use of a water lance is undesirable because it introduces cold water into the furnace, inducing thermal stress to the tubes, decreasing the furnace wall tube life and increasing the maintenance and replacement costs of the boiler.

Other prior art methods have addressed the problem of ash accumulation on furnace walls with chemical techniques for darkening the ash on the walls. For example, U.S. Pat. No. 5,819,672, incorporated herein by reference, describes the addition of a darkening agent such as iron oxide and, preferably, also a fluxing agent to produce a dark ash coating or an additional dark ash coat over the existing ash on the furnace walls. Because the ash is darkened, not only is the tendency of the ash to reflect heat back into the furnace reduced, but the heat absorption by the ash is increased, thereby reportedly aiding transfer of heat from the furnace through the walls thereof. Although the additives may be applied to the coal, the preferred method contemplates applying the dark coat directly to the ash. In any event, such techniques do not eliminate—or even reduce—ash accumulation and suffer from various other disadvantages as well. For example, pursuant to such techniques, ash still is allowed to build up on the surfaces at previous rates with the attendant problems, such as the need for routine cleaning or replacement.

In the above-noted article in *Power Engineering,* it is reported that ADA Environmental Solutions has experimented with the application of a proprietary mixture of iron oxides and stabilizing chemicals to coal prior to combustion to enhance the viscosity characteristics of the slag formed from burning PRB coal and that the preliminary results from this experimentation "have been very promising." However, no further information is provided in the article as to the composition of the additive and, although the article later discusses ash control, the article nowhere discusses the additive with respect to the ash control. Indeed, the article indicates that ash accumulation and high FEGT are still significant problems, requiring the use of water lances.

Thus, the industry is still searching for an effective and efficient means for darkening the ash and reducing the FEGT, slagging and ash accumulation on surfaces in coal-burning furnaces. Techniques that accomplish such objectives, while avoiding the need for purchasing and operating equipment such as soot blowers and water lances would be particularly desirable. And, of course, it is also especially desirable that the technique avoid raising adverse environmental implications.

SUMMARY OF THE INVENTION

Briefly, therefore, the present invention is directed to a novel method for inhibiting accumulation of reflective ash on surfaces in a furnace in which high calcium-containing coal is burned. According to the method, an effective amount of an iron compound is added to the coal to produce treated coal, free of added fluxing agent, and the treated coal is then burned.

The present invention also is directed to a novel method for increasing the melting point of ash produced during the burning of calcium-containing coal. According to the method, an effective amount of an iron compound is added to the coal to produce treated coal, and the treated coal is burned, producing ash of increased melting point.

Among the several advantages found to be achieved by the present invention, therefore, may be noted the provision of a method for darkening ash formed in the combustion of coal; the provision of such method that also reduces the tendency of the ash to accumulate on surfaces in the furnace; the provision of such method that also reduces the FEGT in the furnace; the provision of such method that improves the overall boiler efficiency and reduces generation cost; the provision of such method that eliminates the need for soot blowers and water lances; the provision of such method that reduces slagging in the furnace; and the provision of such method that avoids introduction of adverse environmental consequences.

DETAILED DESCRIPTION OF THE PREFERRED EMBODIMENTS

In accordance with the present invention, it has been discovered that, surprisingly, a darker ash may be produced and accumulation of reflective ash on surfaces in a furnace may be reduced simply by adding iron oxide to calcium-containing coal prior to combustion of the coal in the furnace. Thus, rather than lowering the melting point of the ash or calcium components thereof by addition of a fluxing agent to encourage adhesion to the furnace surfaces as described in U.S. Pat. No. 5,819,672, the process of the present invention involves raising the melting point to inhibit such adhesion. Moreover, it has been found that the addition of the iron oxide not only darkens the ash and inhibits the tendency of the ash to adhere to the furnace surfaces but, accordingly, also reduces the FEGT and consequently slag and fouling deposit formation. In fact, the improvements in furnace performance resulting from the method of this invention have been discovered to be even greater than those achieved with the conventional treatments by soot blowers and water lances, thus eliminating the need for such equipment. And all of this has been found to be accomplished without any detected adverse environmental consequence.

While not wishing to be bound by any particular theory of operation, applicant believes that the present invention operates by conversion of the calcium oxide formed upon combustion of the coal to calcium ferrite, thereby converting calcium oxide in the ash to relatively higher melting point and darker calcium ferrite. This conversion may be illustrated by the following idealized formula wherein ferric oxide is the additive:

$$CaO+Fe_2O_3 \rightarrow Ca(FeO_2)_2$$

In any event, according to the present invention, a composition comprising an iron compound is added to the calcium-containing coal prior to combustion of the coal, preferably prior to delivery of the coal to the furnace and most desirably prior even to grinding the coal. The iron compound in the most desirable embodiment contemplated by the invention is iron oxide, especially ferric oxide. It is also desirable that the additive composition contain no other component that interferes with the ability of the iron compound to raise the melting (or fusion) point of the resulting ash. The additive composition particularly should not contain a fluxing compound or an adhesive or other substance that increases the tendency of the ash to adhere to the furnace surfaces.

In one preferred embodiment, the additive is a composition of iron oxide (especially in the form of ferric oxide) and clay, which is primarily silica with traces of alumina and other calcium and magnesium compounds. One such preferred formulation comprises 93% by weight ferric oxide, 5% by weight silica, with the remainder made up of alumina and other calcium and magnesium compounds. Hematite ore has been found to be a particularly appropriate additive composition. However, in another preferred embodiment, the additive composition may be the iron compound, with no other ingredients other than at most minor impurities.

The preferred form of the additive composition is a powder. However, other forms, such as a suspension of that powder in a liquid such as a liquid hydrocarbon (e.g., kerosene), may be employed if so desired. Although the liquid may be water, such is not desirable for the obvious thermodynamic and other disadvantages of introducing water into the combustion process.

The additive composition is applied to the coal, such as by spraying or spreading, in an amount sufficient to provide an effective amount of the iron compound to combine with the calcium content of the coal. In the context of inhibition of ash on the furnace walls, by "an effective amount" of the iron compound what is meant is an amount that is sufficient to result in less ash deposition on the furnace walls when the coal treated with the iron compound is burned than forms on the walls when equivalent coal without the iron compound treatment is burned under equivalent conditions. In the context of increasing the melting point of the ash produced when the coal is burned, by "an effective amount" of the iron compound what is meant is an amount that is sufficient to increase the melting point of the ash produced when the coal is burned over the melting point of the ash produced when equivalent coal without the iron compound treatment is burned under equivalent conditions. Such ash having a melting point higher than that of the ash produced when equivalent coal without the iron compound treatment is burned under equivalent conditions is referred to herein as "ash of increased melting point."

The optimal amount of iron compound to be added to the coal depends on the calcium content of the coal. Generally, however, when the iron compound is ferric oxide and the coal is of sub-bituminous type from the Western United States and particularly PRB coal, the optimal amount of iron compound has been found to be from about 0.1% to about 1.0%, such as about 0.1% to about 0.75%, more preferably about 0.25% to about 1.0%, even more preferably about 0.25% to about 0.75%, especially about 0.5%, based on the weight of the coal. Based on the theorized formula set forth above, this represents, surprisingly, only about one-sixth the amount of ferric oxide required by the stoichiometry. Although greater amounts of iron compound may be used, it is believed that there is currently no economic advantage to doing so.

After application of the additive composition to the coal, the treated coal then is ground, if not already ground, and conveyed to the furnace, wherein it is exposed directly to the flame envelope of the furnace combustion process. As described above, the resulting ash is darker and has a higher melting point compared to the ash formed from coal not treated in accordance with this invention. In fact, rather than tenaciously adhering to the exposed surfaces, the darkened ash is gas-borne fly ash, most of which escapes from the furnace with the exhaust gases, reducing or even eliminating the need for cleaning out the ash from the furnace wall. And because the product comprises calcium, iron and oxygen, which pose no environmental concern. Moreover, because the FEGT is lower when the coal is treated with the iron compound according to this invention, use of the water lance may be eliminated.

The following examples describe preferred embodiments of the invention. Other embodiments with the scope of the claims herein will be apparent to one skilled in the art from consideration of the specification or practice of the invention as disclosed herein. It is intended that the specification, together with the examples, be considered exemplary only, with the scope and spirit of the invention being indicated by the claims which follow the examples.

EXAMPLE 1

Efficacy of ferric oxide in reducing furnace slagging caused by white reflective ash was tested in a 35 MW boiler furnace manufactured in 1967 and designed for high sulfur bituminous coal. The coal fed to the furnace was switched to calcium-rich PRB coal in the 1980's, causing white ash slagging, which increased the furnace exit gas temperature (FEGT) and the boiler exit gas temperature, limiting operation of the unit to reduced load despite removal of furnace slag by soot blowers and with a water lance, and requiring flue gas conditioning to meet opacity compliance. The use of the water lance was discontinued as ferric oxide was added to PRB coal in dosage rates varying from 0.25% to 1.0%, based on the weight of the coal. The FEGT was measured continuously with an optical pyrometer located at the furnace exit level and the plant operating parameters were monitored routinely. Upon such treatment, slagging was reduced significantly and the FEGT showed a reduction of 50 to 115° F. (28 to 64° C. reduction) during operation at about 30 MW. The color of the furnace bottom ash and fly ash darkened as the dosage rate increased. The bottom ash was of fine size and contained no lumpy slag particles. The load fluctuated from 31 MW to 15 MW due to demand constraint, but during operation at 30 MW the furnace wall remained visibly clean and the fireball was tinted orange. De-superheater spray, which prior to the addition of the ferric oxide operated constantly at 30 MW load, dropped to zero at a ferric oxide dosage rate of 0.5% and higher, based on the weight of the coal, and remained at zero for the remainder of the test period. Moreover, opacity, $SO_2$ and $NO_x$ were found to be well under compliance level, with the $NO_x$ level actually decreasing by 15% from the pre-test level. It is believed that the $NO_x$ reduction was due to the use of less (7.5%) excess air compared to the normal operating level of 10–11%.

EXAMPLE 2

A furnace was operating at an average heat rate of 11,892 Btu/kwh. Upon installation of a water lance and operation of the water lance twice a day, the heat rate dropped to 11,615 Btu/kwh. The coal fed to the furnace then was treated with 0.5% ferric oxide, based on the weight of the coal, and the use of the water lance was discontinued. After treatment, and without use of a soot blower or water lance, the heat rate was measured at 11,231 Btu/kwh, representing a reduction of 5.5% in coal usage, which at 7,800 tons of coal a year and US$24/ton, translates into a savings of US$187,000 a year. During the treatment period, the furnace remained clean and slag did not build up on the walls. There was a thin film of ash on the surfaces of the tubes. At 30 MW load on the generator, the steam temperatures remained reasonably constant at 870–890° F. (465–477° C.), compared to the design temperature of 900° F. (482° C.).

All references, including without limitation all papers, publications, presentations, texts, reports, manuscripts, brochures, internet postings, journal articles, periodicals, and the like, cited in this specification are hereby incorporated by reference. The discussion of the references herein is intended merely to summarize the assertions made by their authors and no admission is made that any reference constitutes prior art. The inventors reserve the right to challenge the accuracy and pertinence of the cited references.

In view of the above, it will be seen that the several advantages of the invention are achieved and other advantageous results obtained.

As various changes could be made in the above methods and compositions without departing from the scope of the invention, it is intended that all matter contained in the above description as shown in the accompanying drawings shall be interpreted as illustrative and not in a limiting sense.

What is claimed is:

1. A method for inhibiting accumulation of reflective ash on surfaces in a furnace in which calcium-containing coal is burned, comprising:

(a) adding to the coal from about 0.1% to about 1%, based on the weight of the coal, of a fluxing agent-free composition comp.rising an iron compound to produce treated coal that is free of added fluxing agent and contains an effective amount of the iron compound; and (b) burning the treated coal.

2. A method as set forth in claim 1, comprising:

(a) adding to the coal from about 0.25% to about 0.75%, based on the weight of the coal, of a fluxing agent-free composition comprising an iron compound to produce treated coal that is free of added fluxing agent and contains an effective amount of the iron compound; and (b) burning the treated coal.

3. A method as set forth in claim 2 wherein the iron compound is iron oxide.

4. A method as set forth in claim 3 wherein burning the treated coal produces calcium ferrite.

5. A method for inhibiting accumulation of reflective ash on surfaces in a furnace in which calcium-containing coal is burned, comprising:

(a) adding to the coal a fluxing agent-free composition comprising an iron compound to produce treated coal that is free of added fluxing agent and contains about 0.1% to about 1% iron oxide, based on the weight of the coal; and (b) burning the treated coal.

6. A method as set forth in claim 4 wherein the treated coal contains about 0.25% to about 0.75% iron oxide, based on the weight of the coal.

7. A method as set forth in claim 5 wherein burning the treated coal produces calcium ferrite.

8. A method for inhibiting accumulation of reflective ash on surfaces in a furnace in which calcium-containing coal is burned, comprising:

(a) adding to the coal enough of a fluxing agent-free composition comprising an iron compound to add to the coal an amount of the iron compound corresponding to about 0.1% to about 1% of the weight of the coal to produce treated coal that is free of added fluxing agent and contains an effective amount of the iron compound; and (b) burning the treated coal.

9. A method as set forth in claim 8 wherein the iron compound is iron oxide.

10. A method as set forth in claim 9 wherein the iron compound is ferric oxide.

11. A method as set forth in claim 10 wherein enough of the fluxing agent-free composition is added to the coal to add to the coal an amount of ferric oxide corresponding to about 0.25% to about 0.75% of the weight of the coal.

12. A method as set forth in claim 11 wherein calcium ferrite is produced when the treated coal is burned.

13. A method as set forth in claim 11 wherein calcium oxide is produced when the treated coal is burned and the iron compound reacts with the calcium oxide to form the calcium ferrite.

* * * * *